United States Patent [19]

Ortize

[11] 4,002,368

[45] Jan. 11, 1977

[54] HANGING CHAIR

[76] Inventor: Eileen S. Ortize, P.O. Box 585, Pawleys Island, S.C. 29585

[22] Filed: Jan. 9, 1976

[21] Appl. No.: 648,106

[52] U.S. Cl. ..... 297/273; 5/120; D6/47

[51] Int. Cl.[2] ..... A47D 13/10

[58] Field of Search ..... 5/120, 122, 123, 130; 297/273, 274, 276, 277, 280, 281, 441, 454; D6/47, 52, 53

[56] References Cited

UNITED STATES PATENTS 1,515,263 11/1924 Matsusaki ..... 5/332 X

FOREIGN PATENTS OR APPLICATIONS 436,606 11/1967 Switzerland ..... 297/457

*Primary Examiner*—James C. Mitchell
*Attorney, Agent, or Firm*—Bacon & Thomas

[57] ABSTRACT

A hanging chair for use in conjunction with an overhead support wherein the chair includes a flexible seat portion having a substantially trapezoidal configuration with the shorter parallel side forming the back portion of the chair, the longer parallel side forming the front portion of the chair and the two non-parallel sides forming the side portions of the chair. Frame members maintain the side portions of the chair in a stretched condition so that an occupant may easily enter and leave the chair.

8 Claims, 4 Drawing Figures

HANGING CHAIR

BACKGROUND OF THE INVENTION

1. Field of the Invention

The present invention generally involves chairs and related furniture structures. More particularly, the present invention relates to the field of prior art pertaining to chairs or seating devices which are utilized by hanging them from overhead or equivalent supports.

2. Description of the Prior Art

It has long been known that chairs and related devices for supporting the human body may be supported off of the floor or ground surface. The simple playground swing and the basic hammock structure are examples of this concept. However, these and related devices are primarily utilized in a recreational or casual manner and are incapable of providing the necessary comfort and support generally found in chairs and other seating devices of a more conventional nature.

Though the prior art has recognized the need for a hanging chair which combines the best advantages of recreation and seating comfort, all heretofore known prior attempts to satisfy this need have been deemed lacking in one respect or another. For example, it is known to provide a rigid chair structure made of metal or wood and merely suspend such structure by a pair of chains or ropes from an overhead support. Such a rigid hanging chair is generally uncomfortable for prolonged seating and is dangerous due to the unavoidable swinging action. It is also known to provide for hanging chairs or swings made from flexible or woven material. These manifestations are generally based upon the doubling up of a hammock structure which serves to support the occupant within a pendulous sack-like configuration. It is impossible for the occupant to derive adequate support, particularly for his back, while seated in this latter type of hanging chair.

SUMMARY OF THE INVENTION

It is an object of the invention to provide for a hanging chair which is of a casual and recreational nature while having the capability of safely and comfortably supporting the occupant therein for prolonged periods of time.

It is another object of the invention to provide for a hanging chair which is compact and may be easily and quickly attached to and removed from any suitable overhead support.

It is yet another object of the present invention to provide for a hanging chair which is simple in construction and economical to manufacture.

It is still yet a further object of the present invention to provide for a hanging chair which is adjustable and capable of conforming to the shape and size of the occupant.

The present invention serves to overcome the disadvantages and deficiencies inherent in prior art hanging chairs and achieves the foregoing objects to providing a hanging chair which includes a flexible seat portion having a substantially trapezoidal configuration wherein the shorter of the two parallel sides forms the back portion of the chair for enclosing and comfortably supporting the back of the user. The longer of the parallel sides forms the front portion of the chair and the two non-parallel sides form the side portions of the chair. Rigid frame members are provided for maintaining the side portions of the chair in a stretched condition in order to facilitate entry into and exit from the chair by the occupant. The chair also includes means carried by the seat for hanging the chair from any suitable overhead support.

Other objects, features and advantages of the present invention will be apparent from the following description of specific embodiments thereof, with reference to the accompanying drawings, which form a part of this specification, wherein like reference characters designate corresponding parts of the several views.

DETAILED DESCRIPTION OF THE PREFERRED EMBODIMENTS

Figure 1:
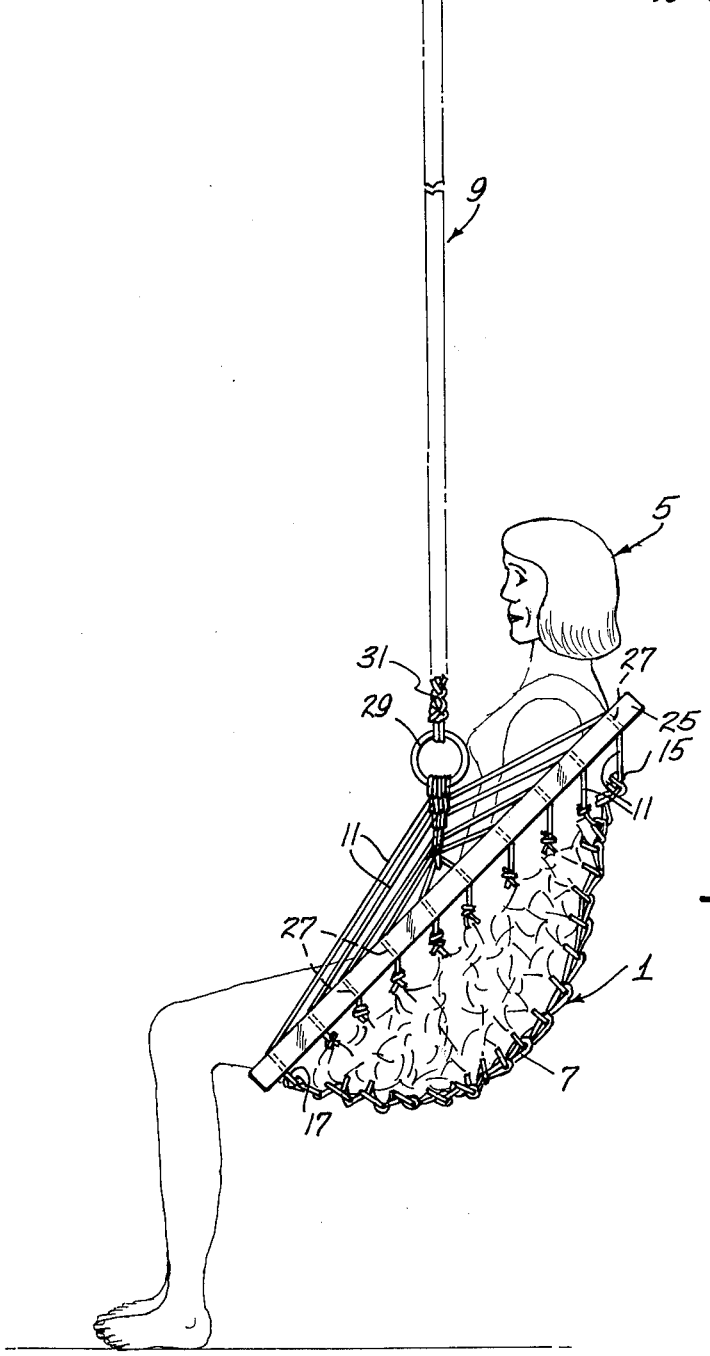
FIG. 1 is a side elevational view of the hanging chair of the present invention shown suspended from an overhead support and being utilized by an occupant.

Referring now to FIG. 1, there is shown a hanging chair 1 according to the present invention suspended from an overhead support 3, such as a ceiling, and utilized by an occupant 5. Chair 1 includes a flexible seat portion 7 and a means 9 for suspending chair 1 from overhead support 3.

Figure 2:
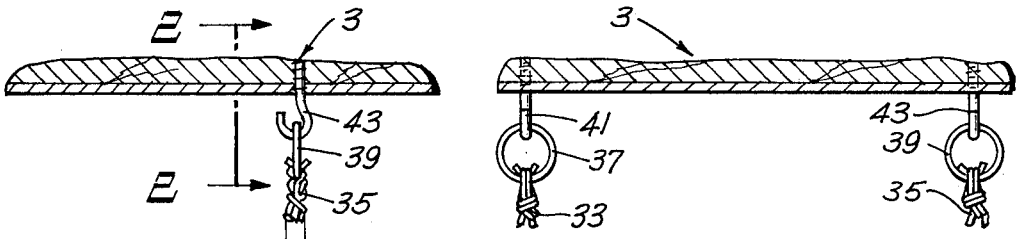
FIG. 2 is a sectional view taken along the line 2—2 of FIG. 1.
Figure 3:
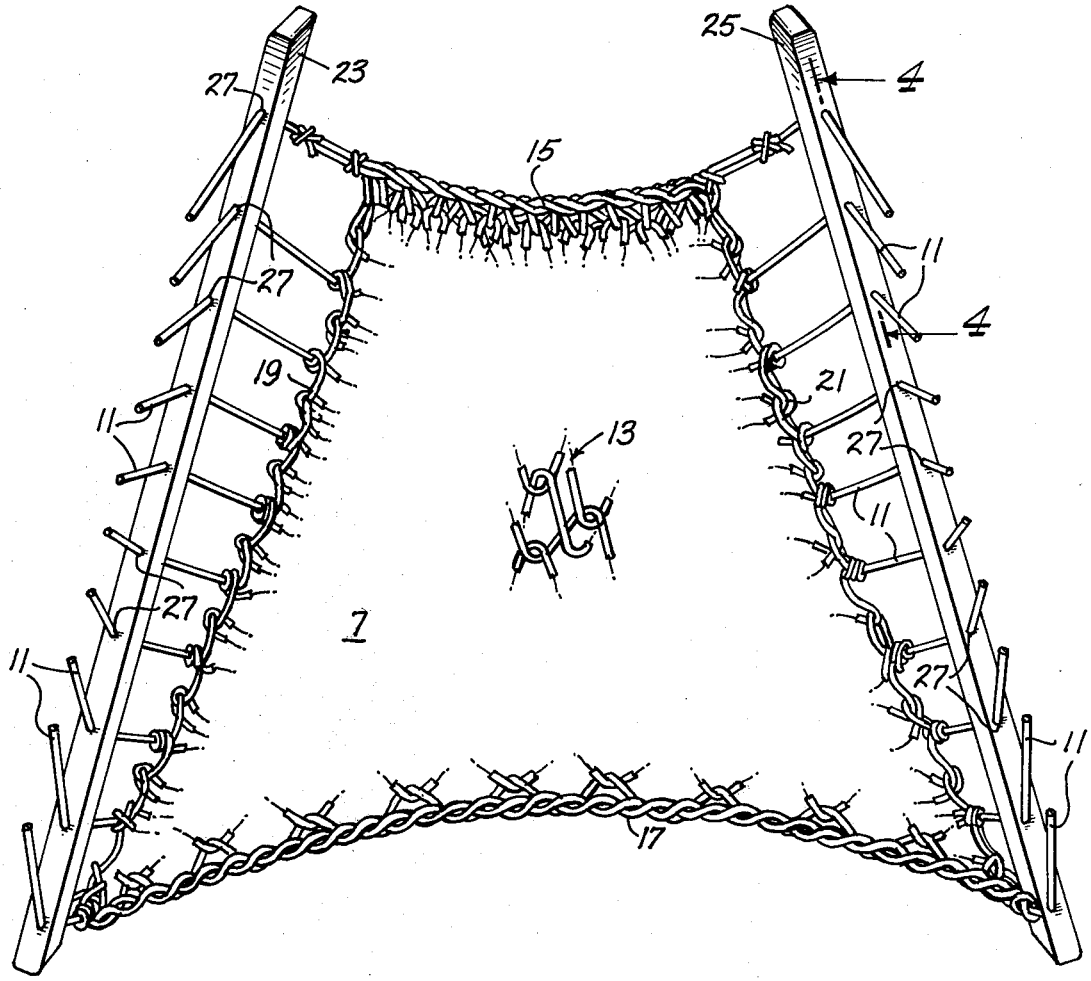
FIG. 3 is a plan view of the hanging chair of FIG. 1, shown partly in section and unoccupied.

As is more clearly depicted in FIGS. 2 and 3, seat portion 7 is preferably formed from a plurality of ropes 11 loosely woven in a bias weave manner as indicated generally at 13. Seat portion 7, when laid out flat, assumes a generally trapezoidal configuration having a short side 15 disposed substantially parallel with a longer side 17 and a pair of opposing non-parallel sides 19 and 21. It is preferred that non-parallel sides 19 and 21 be of substantially the same length, thereby imparting an overall isoceles trapezoidal configuration to seat portion 7. Because of the nature of bias weave 13, seat portion 7 is capable of expanding in all directions to thereby enclose and conform to both the size and shape of occupant 5. It is further preferred that sides 15 and 17 be formed from a four-handed braid in order to impart rigidity thereto.

The trapezoidal configuration of seat portion 7 serves to locate shorter parallel side 15 at the back portion of chair 1 and longer parallel side 17 at the front portion of chair 1. In this manner, occupant 5 may easily gain access into seat portion 7 because of the greater breadth of side 17. Once in seat portion 7, shorter parallel side 15 forming the back portion of chair 1 serves to provide firm and comfortable support by enclosing the back portion of occupant 5, as clearly shown in FIG. 1.

Figure 4:
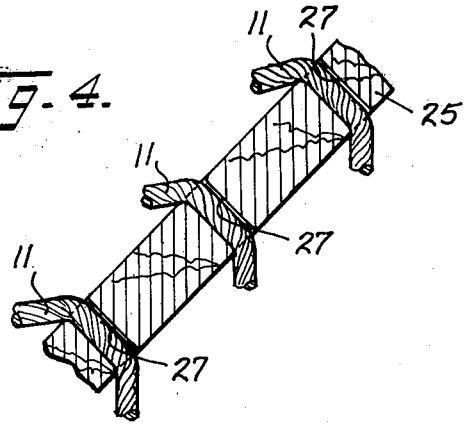
FIG. 4 is an enlarged fragmentary sectional view taken along the line 4—4 of FIG. 3.

A pair of rigid frame members 23 and 25 are provided for the purpose of maintaining non-parallel sides 19 and 21 of seat portion 7 in a stretched or expanded condition to further facilitate entry into chair 1 by occupant 5. Members 23 and 25 are preferably of elongate configuration and may be secured adjacent sides 19 and 21 by providing a plurality of apertures 27 along the lengths of members 23 and 25 and passing portions of ropes 11 therethrough. This is more clearly depicted in FIG. 4. The free ends of ropes 11 extending through members 23 and 25 may be joined and secured to support rings, preferably of metal, located above and substantially intermediate the ends of members 23 and 25 as shown in FIG. 1. Though only a single ring 29 is depicted for member 25, it is to be understood that member 23 is also provided with its corresponding support ring.

Hanging means 9 for suspending chair 1 is preferably woven or braided from a plurality of ropes 31, which ropes 31 are preferably of the same structure and nature as that of ropes 11. As seen in FIG. 2, suspension means 9 includes two braided rope portions 33 and 35 which are provided with support rings 37 and 39 at their ends. A pair of threaded hooks 41 and 43 may be screwed within overhead support 3 for receiving and supporting chair 1 through support rings 37 and 39. Accordingly, chair 1 may be quickly and easily attached to or removed from overhead support 3.

By virtue of the free and unrestricted manner in which ropes 11 are passed through apertures 27 in members 23 and 25, occupant 5 may adjust the conformity and comfort of chair swing 1 by sliding members 23 and 25 up and down with respect to ropes 11. As also shown in FIG. 3, members 23 and 25 serve to facilitate entry into seat portion 7 by occupant 5 by virtue of their disposition. Because of the trapezoidal configuration of seat portion 7, members 23 and 25 converge from front side 17 towards back side 15.

Though the foregoing description of the chair swing of the present invention serves to detail the preferred embodiment thereof, it is to be understood that various modifications and other embodiments are entirely possible within the scope and intent of the invention. For example, seat portion 7 may be made from any suitable flexible material, woven or unwoven, provided it assumes the general configuration of a trapezoid, preferably an isoceles trapezoid. Frame members 23 and 25 may be connected to non-parallel sides 19 and 21 in any manner deemed suitable so long as members 23 and 25 serve to maintain sides 19 and 21 in a somewhat stretched or expanded condition. Further, any suitable suspension means 9 may be utilized for hanging chair 1 from overhead support 3. For example, suspension means 9 may comprise two chains which have one pair of adjacent ends attached to frame members 23 and 25 and their opposite adjacent ends secured to hooks 41 and 43. Ropes 11 and 31 may be made from either natural or synthetic materials.

Though overhead support 3 is depicted in the form of a ceiling or beam, it is entirely possible to utilize chair swing 1 of the present invention in conjunction with a fixed or portable frame having an overhead bar or similar means for supporting suspension means 9.

It is to be further understood that the forms of the invention herein shown and described are to be taken as preferred examples of the same, and that various changes in the shape, size, arrangement of parts and applications may be resorted to, without departing from the spirit of the invention or scope of the subjoined claims.

I claim:

1. A chair for hanging from an overhead support, which chair comprises:

a. a flexible seat having a substantially trapezoidal configuration formed substantially of loosely woven material which permits the seat to expand in all directions wherein:
   1. the shorter parallel side forms the back portion of the chair;
   2. the longer parallel side forms the front portion of the chair; and
   3. the two non-parallel sides form the side portions of the chair;

b. a rigid frame member carried by each side portion, wherein each frame member includes a plurality of aperture through which portions of the seat material are passed for maintaining the side portions in a stretched condition; and c. means carried by the seat for hanging the chair from the overhead support.

2. The chair of claim 1 wherein each rigid frame member is of an elongate configuration such that the two frame members converge towards the rear portion of the chair when the chair is hanging from the overhead support.

3. The chair of claim 1 wherein the material is bias woven rope.

4. The chair of claim 1 wherein the back and front portions are formed from rope braided in a four-handed manner.

5. The chair of claim 1 wherein the means for hanging the chair includes two flexible elongated members having one pair of their adjacent ends secured to the seat.

6. The chair of claim 5 wherein the flexible elongated members are formed of braided rope.

7. The chair of claim 5 wherein the flexible elongated members are secured to the seat by a pair of metal rings.

8. The chair of claim 5 wherein the free ends of the flexible elongated members are each provided with a metal ring for removable attachment to the overhead support.

* * * * *